United States Patent [19]

Cotton et al.

[11] Patent Number: 4,531,387

[45] Date of Patent: Jul. 30, 1985

[54] COMBINATION APPLIANCE WITH SLIDING DOOR

[75] Inventors: Curran D. Cotton; David I. Ellingson; William J. Noe; James D. Wilson, all of Newton, Iowa

[73] Assignee: The Maytag Company, Newton, Iowa

[21] Appl. No.: 565,731

[22] Filed: Dec. 27, 1983

[51] Int. Cl.[3] ..... D06F 29/00

[52] U.S. Cl. ..... 68/3 R; 68/20; 220/345; 312/330 R; 312/279

[58] Field of Search ..... 68/3 R, 12 R, 13 R, 68/19.2, 20, 23 A, 23 R, 26, 130, 196, 212; 49/40 R; 220/345; 312/297, 330 R, 279, 273

[56] References Cited

U.S. PATENT DOCUMENTS

| | | | |
|---|---|---|---|
| 2,273,998 | 2/1942 | Rueger | 220/345 X |
| 2,276,635 | 3/1942 | Weber | 220/345 |
| 2,732,700 | 1/1956 | Dunn | 68/14 |
| 2,793,518 | 5/1957 | Geldhof | 68/19.2 |
| 2,817,501 | 12/1957 | Schubert | 220/345 X |
| 2,833,137 | 5/1958 | Geldhof | 68/19 |
| 2,897,035 | 7/1959 | Dorsey | 312/330 R |
| 3,545,235 | 12/1970 | Menk | 68/19.2 |
| 3,611,756 | 12/1971 | Brucken | 68/3 R |
| 4,454,732 | 6/1984 | Burkland et al. | 68/19.2 X |

FOREIGN PATENT DOCUMENTS

| | | | |
|---|---|---|---|
| 2303186 | 7/1974 | Fed. Rep. of Germany | 220/345 |
| 69290 | 5/1958 | France | 68/23 |
| 59-2800 | 1/1984 | Japan | 68/3 R |

OTHER PUBLICATIONS

Whirlpool Form No. 2527 "Thin Twin Laundry System".

*Primary Examiner*—Philip R. Coe
*Assistant Examiner*—Frankie L. Stinson
*Attorney, Agent, or Firm*—Richard L. Ward

[57] ABSTRACT

A combination appliance is provided having a washing machine and a dryer separately supported above the washing machine. The physical arrangement of the washing machine/dryer combination provides a compartment below the dryer cabinet and behind the washing machine cabinet. A recessed area in the top cover of the washing machine and below the bottom of the dryer defines a pocket which is in communication with the compartment. A sliding access door is operable within the recessed area and is manually movable to a posture partially within the compartment and partially within the pocket for providing clear access to within the washing machine.

7 Claims, 3 Drawing Figures

COMBINATION APPLIANCE WITH SLIDING DOOR

BACKGROUND OF THE INVENTION

This invention relates generally to the field of combination appliances and more particularly to a combination stack fabric washer and dryer having a generally horizontal sliding access door associated with the washer.

Previously known combination appliances for washing and drying fabrics of the type where a fabric dryer is arranged in a stack posture above a fabric washer have generally shown the fabric dryer directly attached to the top of the fabric washer. These previous stacked combination appliances have also shown washer access doors which are pivotally mounted for providing access to the interior of the washer.

One particular manufacturer of a stacked laundry system shows the dryer cabinent mounted directly to the top rear of the washer cabinet with the rear of the dryer cabinet and the rear of the washer cabinet sharing a common vertical plane. The rear of the washer cabinet is open below the dryer cabinet allowing space for connecting electrical and water supplies and a front removable sloping panel below the dryer provides front access to these various supplies. The washer access door is pivoted at the rear and opens upwardly toward the sloping panel to provide access to within the washer.

Dunn, in U.S. Pat. No. 2,732,700 issued Jan. 31, 1956, discloses a wringer washing machine having a removable sliding lid or tray for covering the tub opening during washing. The lid has a downwardly turned lip or flange around its periphery and slides on a shoulder portion of the tub sides. Each side of the lid has a pair of rubber pads for preventing scratching or rattling as the lid slides upon the shouldered portion of the tub sides.

Geldhof, the U.S. Pat. No. 2,833,137 issued May 6, 1958, shows a combination washing and drying machine with the dryer mounted on top of an intermediate air circulating compartment which is secured to the rear of the washer top cover. The dryer and air circulating compartment are shown overhanging the rear of the washer. The washer access door is hinged at the rear and opens toward the intermediate air circulating compartment.

Menk, in U.S. Pat. No. 3,545,235 issued Dec. 8, 1970, discloses a vertically stacked combination top loading clothes washer and front loading clothes dryer. The dryer is mounted directly to the washer top cover and slightly overhangs the rear of the washer cabinet. The lower front portion of the dryer cabinet, below the dryer access door, is slanted rearwardly to provide space for opening the washer access door which is pivotally mounted to the top cover of the washer.

The prior art has thus shown stacked dryer and washer combinations where the dryer has been mounted to the washer in a manner to provide a space at the rear of the washer and below the dryer for routing various utility lines. Also, there has been shown a stack arrangement where the rear of the washer and the dryer are located in a common vertical plane and space has been provided below the dryer for the various utility lines. These stack arrangements have utilized a pivotally mounted access door for providing access to within the washer. A removable sliding lid has been shown in a wringer washer environment but there has been no known showing of a combination appliance where the fabric dryer is independently mounted on a stand for positioning the bottom of the dryer in spaced juxtaposition to the top cover of the fabric washer and where a non-removable sliding access door is associated with a horizonal pocket in the top cover of the fabric washer.

SUMMARY OF THE INVENTION

It is therefore an object of the instant invention to provide for full access to the interior of the washer through the use of a sliding access door.

It is a further object of the instant invention to provide a combination appliance having a door receiving horizontal pocket allowing the use of a sliding access door on the washer.

Briefly, the instant invention achieves these objects in a combination appliance. A fabric washer includes an enclosure having a generally horizontally disposed top cover defining an access into the fabric washer. A fabric dryer is supported generally above the fabric washer and is positioned with a rearwardly overhanging relationship thereto to define a compartment below the fabric dryer and behind the fabric washer. A slidable panel is associated with the top cover. Apparatus is provided for mounting the panel on the top cover and for defining a generally horizontal pocket extending rearwardly into communication with the compartment. The slidable panel is movable in a generally horizontal plane between a first forward position covering the fabric washer access and a second rearward position disposed generally below the fabric dryer and extending into the compartment for exposing the fabric washer access.

Operation and construction of the combination appliance having a pocket for a sliding access door and further objects and advantages thereof will become evident as the description proceeds and from an examination of the accompanying three sheets of drawings.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
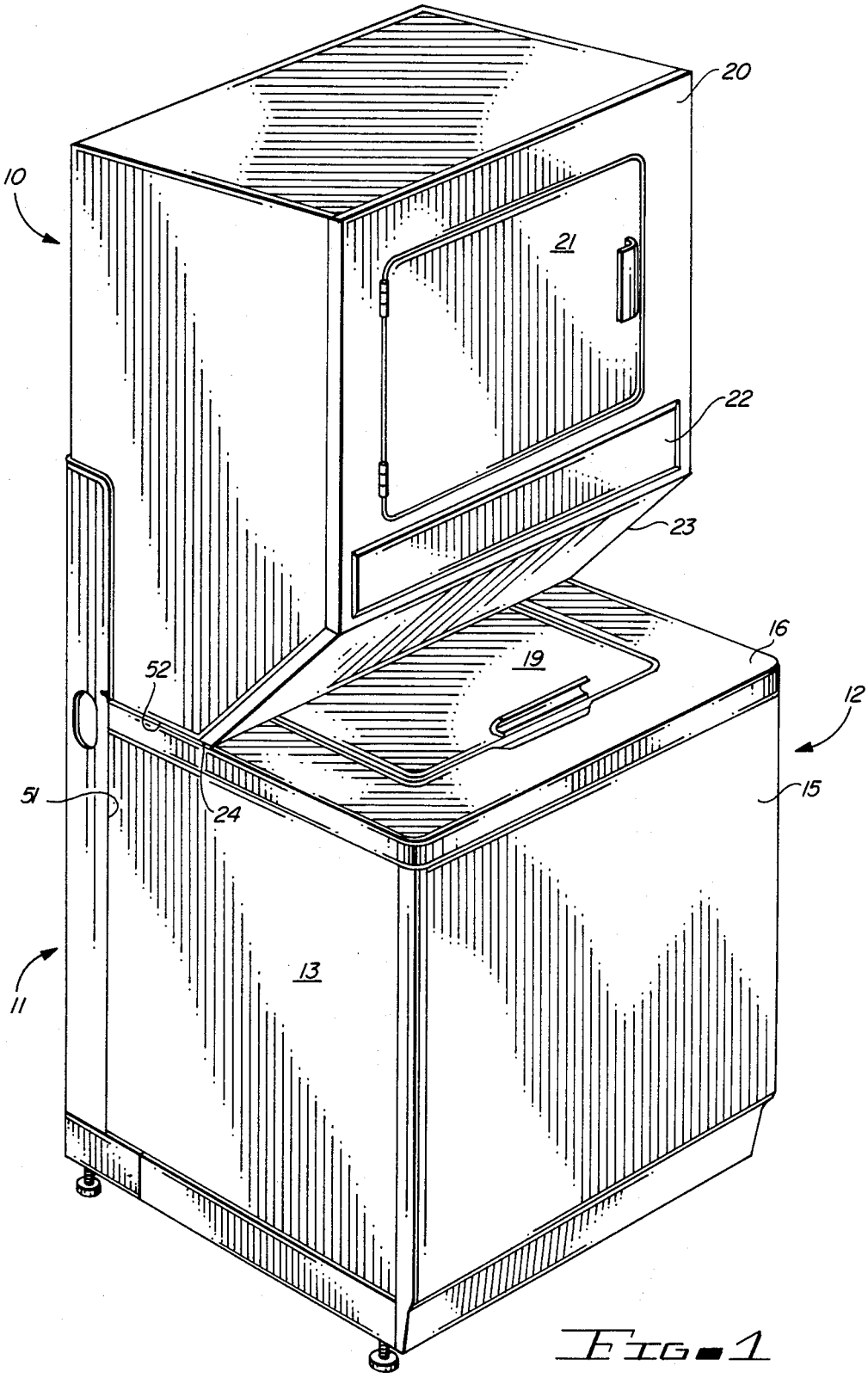
FIG. 1 is an isometric view of a washer/dryer pair mounted in a stack arrangement through a support stand.

Referring now to the drawings and in particular to FIG. 1, there is shown a combination appliance including a fabric dryer 10 mounted on an appliance support stand 11 above an automatic washing machine 12.

The automatic washing machine 12 is housed within a generally rectangular cabinet having a three-sided enclosure member forming the sides 13 and rear 14 of the cabinet. A vertically oriented front panel 15 completes the peripheral cabinet of the washing machine 12. The cabinet of the washing machine 12 also includes a substantially horizontally disposed top cover 16 having a horizontally slidable access door 19 for providing access to the interior of the washing machine 12.

Figure 3:
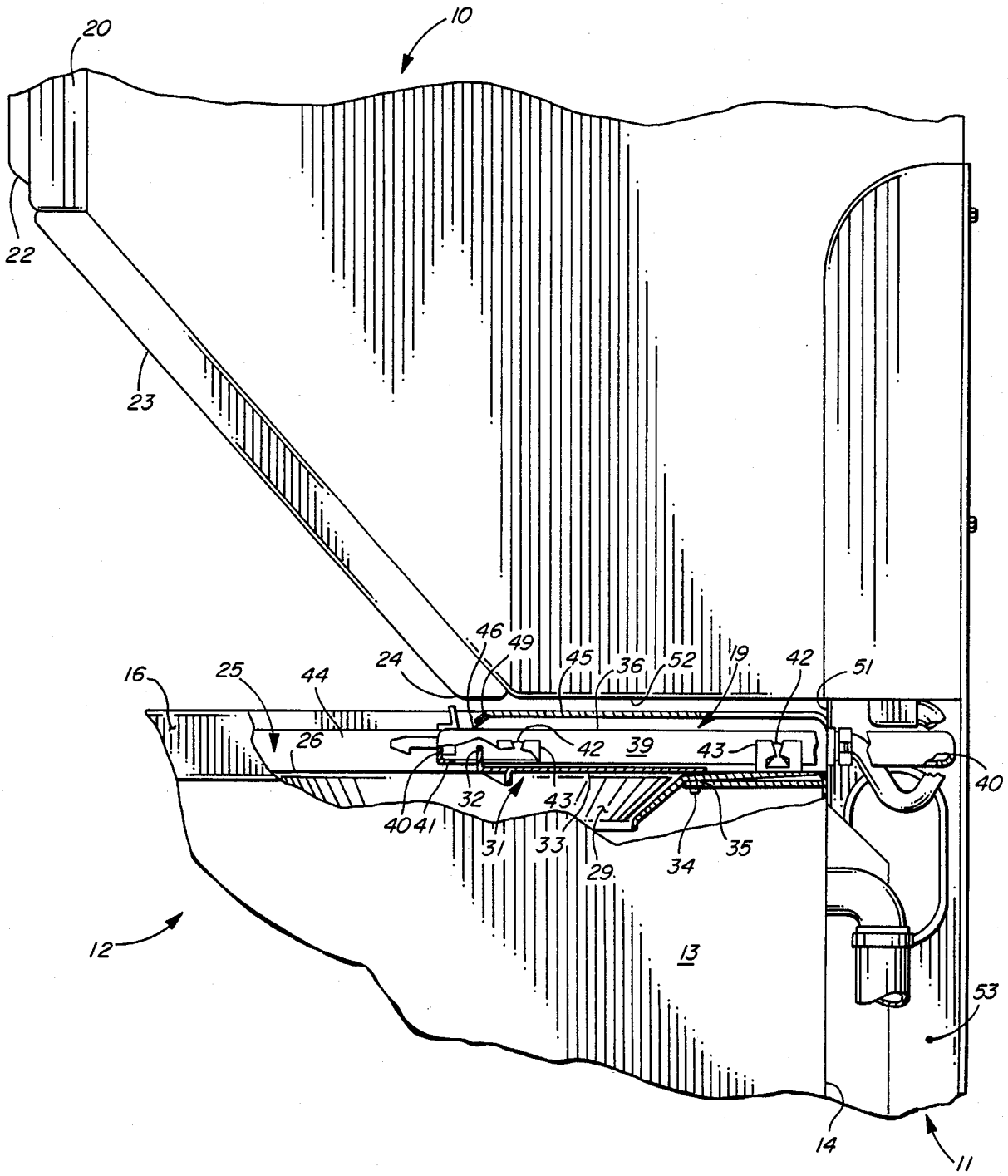
FIG. 3 is a section view of the top portion of the washing machine taken generally along lines 3—3 of FIG. 2.

The fabric dryer 10 is shown mounted in a cantilevered fashion on the support stand 11 directly above the washing machine 12 and also has a generally rectangular enclosure which is substantially shorter in front-to-back depth than that of the washing machine 12. The vertically oriented front panel 20 includes an access door 21 for loading and unloading fabrics to be dried. Controls, such as control panel 22, may be positioned on the dryer 10 and/or washer 12 through which the washing machine 12 and dryer 10 are controlled. As further shown in FIG. 1, the lower front panel portion 23 of the dryer 10 tapers rearwardly from a point adjacent the bottom edge of the control panel 22. As best shown in FIG. 3, the lower edge 24 of the dryer lower front panel portion 23 is juxtaposed to but spaced slightly above the top cover 16 of the washing machine 12. The dryer heater and drive assembly (not shown) are located within the lower part of the dryer 10 behind the sloping lower front panel portion 23.

Figure 2:
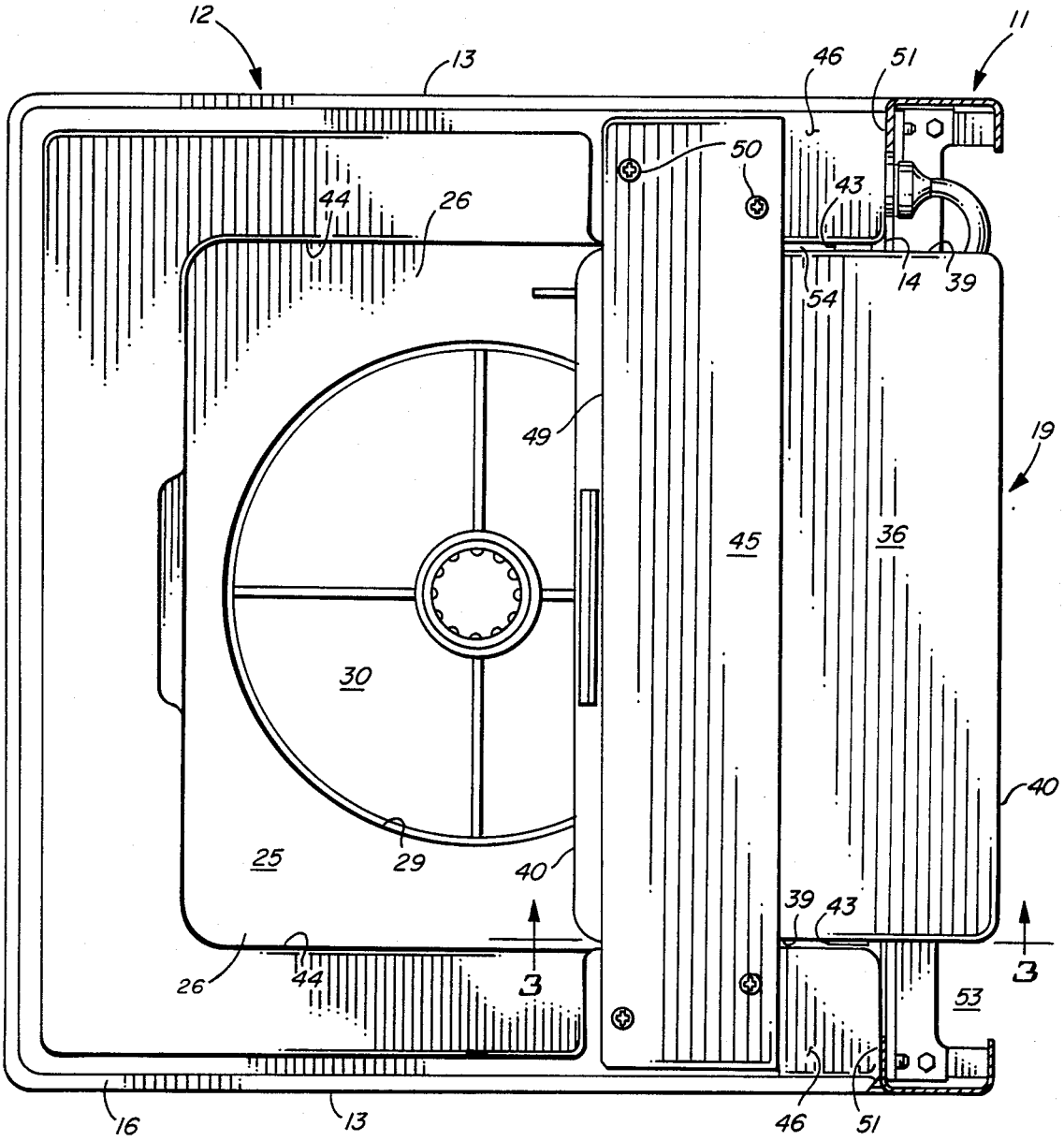
FIG. 2 is a top plan view of the washing machine with the vertical columns of the support stand shown in cross section.

Referring now to FIGS. 2 and 3, there is shown a top plan view and a partial cross sectional view of the top cover 16 of the washing machine 12 of FIG. 1. As previously discussed relative to FIG. 1, the top cover 16 completes the enclosure of the washing machine 12 and is generally rectangular in shape. The top cover 16 includes a generally centrally located rectangular depression 25 which has a substantially flat front-to-rear area on either side defining guideways 26, as best shown in FIGS. 2 and 3, for receiving the front-to-rear movable sliding access door 19. The rectangular depression 25 in the top cover 16 extends rearwardly the full front-to-rear depth of the top cover 16 to enable the access door 19 to slide rearwardly past the vertical plane of the rear 14 of the washing machine 12 as shown in FIGS. 2 and 3. The rectangular depression 25 of the top cover 16 also extends downwardly into a tapered substantially circular tub access opening 29 for loading and unloading clothing into and out of the tub 30.

As best shown in FIG. 3, approximately the rear quarter of the circular tub access opening 29 is covered by a thermoplastic splash guard 31. A front wall 32 of the splash guard 31 extends equally above and below the horizontally disposed main body 33 of the splash guard 31. The splash guard 31 is secured to the top cover 16 by means of a plurality of molded studs 34 which extend downward through the top cover 16 and receive threaded fasteners 35 on the bottom side of the top cover 16.

As further shown in FIGS. 2 and 3, the sliding access door 19 cooperates with the splash guard 31 to fully cover the tub access opening 29. The access door 19 is rectangular in shape and is sized to fit within the rectangular depression 25 in the top cover 16. The access door 19 has a substantially flat horizontally disposed top 36, vertical side walls 39, vertical end walls 40 and a bottom peripheral edge or turned in lip 41. The side walls 39 of the access door 19 each further include a pair of spaced-apart keyhole shaped apertures 42 for receiving thermoplastic glides 43. The thermoplastic glides 43 are fashioned so that they simultaneously can contact the side walls 44 of the depression 25 and the guideways 26 in the depression 25 as shown in FIGS. 2 and 3.

A bridge 45 preferably formed from sheet metal extends from side to side across the rear of the top cover 16. The bridge 45 is mounted on raised segments 46 at each side of the top cover 16 for positioning the front edge 49 of the bridge 45 slightly above the access door 19 as shown in FIG. 3. The bridge 45 is secured to the raised segments 46 through a plurality of self-tapping screws 50 which extend into the raised segments 46 of the top cover 16 as shown in FIG. 2. As best shown in FIG. 3, when the splash guard 31 is secured to the top cover 16, the sliding access door 19 is operably positioned in the depression 25, and the bridge 45 is secured, the access door 19 will be trapped and substantially non-removable. The bottom lip or edge 41 at the rear of the access door 19 will engage that portion of the front wall 32 of the splash guard 31 which extends upwardly and the front edge 49 of the bridge 45 will engage the top 36 of the access door 19 if an attempt should be made to remove the access door 19. The access door 19 may be removed from the rectangular depression 25 for servicing by first removing the bridge 45 from the top cover 16.

The non-removable access door described herein is also described and is claimed in a copending application, Ser. No. 565,930, entitled "Sliding access Door for Washing Machine" filed on Dec. 27, 1983 by William J. McNally and John C. Mellinger and assigned to the assignee of the instant invention.

When the washing machine 12 and dryer 10 are arranged in an operative posture as shown in FIGS. 1 and 3, the rear wall 14 of the washing machine 12 is butted against the forward walls 51 of the support stand 11 as best shown in FIG. 2 and the dryer 10 is supported on the support stand 11 in a posture whereby the bottom wall 52 of the dryer 10 is spaced slightly above the top cover 16 of the washing machine 12. The combination of the dryer 10 on the support stand 11 and the washing machine 12 provides a generally rectangular compartment 53 below the dryer 10, behind the washer 12 and extending downwardly to the support surface. The open rear of the rectangular depression 25 in the top cover 16 of the washer 12 is in communication with this compartment 53 below the dryer 10 and behind the washer 12. As best shown in FIGS. 2 and 3, the bottom wall 52 of the dryer 10 and the depression 25 of the top cover 16 combine to form a pocket 54 which is in communication with the compartment 53.

When the access door 19 is manually moved rearwardly within the depression 25 of the top cover 16, the access door 19 will be positioned within the pocket 54 below the bottom wall 52 of the dryer 10 and will also extend rearwardly into the rectangular compartment 53. As shown in FIG. 3, rearward movement of the access door 19 will end when contact is made with the front wall 32 of the splash guard 31. This will position the access door 19 partially in the pocket 54 and partially within the compartment 53.

The incorporation of a sliding access door 19 in a combination appliance as described herein allows the front-to-rear depth of the combination appliance to be minimized while maximizing accessibility to within the washer 12 since there is no pivotal access door occupying space in the sloping frontal area of the dryer 10.

The front-to-rear depth of the combination appliance is minimized while maximizing accessibility to within the washer 12 in a specific embodiment of a combination appliance where the lower edge 24 of the fabric dryer 10 is located at approximately the front-to-rear midpoint of the side of the fabric dryer 10 having front-to-rear depth of 21 inches. In this embodiment, the overall front-to-rear depth of the washer 12 is 24 inches from the forward wall 51 of the support stand 11 and the rear end wall 40 of the closed access door 19 is located approximately 8 inches forward of the rear 14 of the washer 12 or from the forward wall 51 of the support stand 11 and directly below the lower edge 24 of the fabric dryer 12. The access door 19 has a front-to-rear dimension of approximately 11½ inches. This posture provides space in the pocket 54 and compartment 53 for at least substantially receiving access door 19. It is noted that the front-to-rear dimension of the vertical columns of the support stand 11 is approximately 3 inches but could be altered in other embodiments for adjusting the size of the compartment 53 and thereby permitting changes in other of the access door associated dimensions.

There has thus been shown an improved access door system for a stacked combination appliance where a pocket cooperatively formed by the washer top cover and the bottom of the stack mounted dryer communicates with a compartment formed behind the washer and below the dryer to provide an open area for receiving a sliding access door when in the posture for providing access to within the washing machine.

In the drawings and specification, there has been set forth a preferred embodiment of the invention and although specific terms are employed these are used in a generic and descriptive sense only and not for purposes of limitation. Changes in the form and the proportion of parts as well as the substitution of equivalents are contemplated as circumstances may suggest or render expedient without departing from the spirit or scope of the invention as further defined in the following claims.

We claim:

1. A combination appliance comprising: a fabric washer including an enclosure having a generally horizontally disposed top cover defining an access into said fabric washer; a fabric dryer supported generally above the fabric washer and positioned with a rearwardly overhanging relationship thereto to define a compartment below the fabric dryer and behind the fabric washer; slidable panel means associated with said top cover; means including a portion of said top cover and a lower portion of said fabric dryer for mounting said panel means on said top cover and for defining a generally horizontal pocket extending rearwardly into communication with said compartment, said slidable panel means being movable in a generally horizontal plane between a first forward position covering said fabric washer access and a second rearward position disposed generally below said fabric dryer and extending into said compartment for exposing said fabric washer access; and means for retaining said slidable panel means in association with said top cover in said first and second positions.

2. The combination appliance as defined in claim 1 wherein said fabric washer top cover includes a recess defining said access into said fabric washer and wherein said slidable panel means is slidably located in said recess.

3. The combination appliance as defined in claim 1 wherein said fabric dryer is supported on an appliance stand with a generally horizontal bottom wall of the fabric dryer cabinet located in spaced juxtaposition to said fabric washer top cover.

4. A combination appliance, comprising: a fabric washer including an enclosure and further including a generally horizontally disposed top cover supported on said enclosure and having a recess defining an access to within said fabric washer; a fabric dryer including cabinet means enclosing fabric drying apparatus and having a generally vertical front panel with an access opening covered by an access door; means for supporting said fabric dryer generally above the fabric washer to position a generally horizontal bottom portion of the fabric dryer cabinet means in spaced juxtaposition to said top cover and generally rearwardly of said fabric washer with a rearwardly overhanging relationship thereto defining a compartment below the fabric dryer and behind the fabric washer, said fabric dryer cabinet means further including a front lower portion tapering between the generally vertical front panel and the generally horizontal bottom portion of the fabric dryer cabinet means to provide clear access to said fabric washer access, said fabric washer top cover and said fabric dryer bottom portion cooperatively defining a generally horizontal pocket extending rearwardly from said top cover recess toward and communicating with said compartment; slidable access closure means defined by a generally horizontal panel disposed in said top cover recess and movable in a generally horizontal plane within said pocket between a first forward position covering said fabric washer access and a second rearward position disposed generally below said fabric dryer bottom portion and extending into said compartment for exposing said fabric washer access; and means for retaining said slidable access closure means in said top cover recess in said first and second positions.

5. A combination appliance as defined in claim 4 wherein said means for supporting includes spaced-apart vertical legs with the rear panel of said fabric washer butting up against said vertical legs when in an operative posture to define said compartment behind said fabric washer and below said fabric dryer.

6. A combination appliance, comprising: support means including a pair of generally horizontally disposed base members engageable with a support surface and a pair of generally vertically disposed members associated with said base members in a spaced-apart cooperative arrangement; a fabric washer including housing means with a horizontally disposed top cover having a recess defining an access to within said fabric washer; a fabric dryer including cabinet means enclosing fabric drying apparatus, said fabric dryer mounted on said vertically disposed members of said support means and positioned generally above and to the rear of said fabric washer for defining a compartment below said fabric dryer and behind said fabric washer, said fabric dryer cabinet means further including a substantially vertical front panel and a tapering lower front panel between the front panel and a generally horizontal bottom panel to allow clear loading and unloading access to said fabric washer, said fabric washer top cover and said bottom panel of said fabric dryer cabinet means being in closely spaced juxtaposition to each other and combining to form a generally horizontal pocket extending rearwardly from said top cover recess toward and communicating with said compartment; a sliding access door disposed in said top cover recess and movable in a substantially horizontal plane within said pocket between a first forward position covering said fabric washer access and a second rearward position exposing said fabric washer access and extending into said compartment below said fabric dryer; and means cooperable with said top cover for retaining said sliding access door in said top cover recess in said first and second positions.

7. A combination appliance as defined in claim 6 wherein said top cover recess includes front and side walls and is open at the rear for communication with said compartment to allow said sliding access door to extend rearwardly into said compartment when in said second rearward position.

* * * * *